United States Patent [19]

Ricke et al.

[11] 3,967,334

[45] July 6, 1976

[54] HOSPITAL BED FOOTBOARD ASSEMBLY

[76] Inventors: Maurine E. Ricke, 153 Smith Road; Vern S. Ryan, 2565 Stone Valley Road, both of Danville, Calif. 94526

[22] Filed: Mar. 31, 1975

[21] Appl. No.: 563,652

[52] U.S. Cl. ..... 5/319; 5/327 R

[51] Int. Cl.[2] ..... A47C 21/00

[58] Field of Search ..... 5/317 R, 327 R, 319

[56] References Cited

UNITED STATES PATENTS

| | | | |
|---|---|---|---|
| 970,357 | 9/1910 | Segesman et al. | 5/332 X |
| 998,996 | 7/1911 | Swenson et al. | 5/319 |
| 2,986,747 | 6/1961 | Posey | 5/327 R |
| 3,523,311 | 8/1970 | Ricke | 5/327 R |

*Primary Examiner*—Paul R. Gilliam
*Assistant Examiner*—Andrew M. Calvert
*Attorney, Agent, or Firm*—Harris Zimmerman

[57] ABSTRACT

A footboard assembly for use with a bed to provide support and positioning of the feet of a bedridden individual includes a pair of brackets adapted for mounting on opposed side rails of a bed. Each bracket includes a right angle member with the upper, horizontal leg resting on the bed rail, and a clamping plate opposed to the lower vertical bracket leg for clamping the rail therebetween. Each bracket includes a collar joined to the vertical leg which slidably receives a vertical support member. A footboard is secured between the vertical support members and rests on the mattress of the bed. The footboard assembly is removably securable to beds of varying widths, heights, and rail configurations.

3 Claims, 3 Drawing Figures

HOSPITAL BED FOOTBOARD ASSEMBLY

BACKGROUND OF THE INVENTION

For a person who must be confined to a bed for an extended period of time, a footboard assembly is often employed to provide necessary positioning and support of the legs of the bedridden person. The feet of a person lying in bed on her back will normally extend obliquely from the legs, as opposed to extending generally perpendicularly from the legs when she is standing. It has been found that when the foot remains relaxed in the obliquely extending position for long periods of time, as is the case for a bedridden patient, the muscles of both the legs and feet undergo a deleterious deterioration. To prevent this occurrence, devices have been designed for use with hospital beds which maintain the feet and legs in positions which allow the muscles to be suitably conditioned to make up for their lack of proper exercise.

In the prior art, these devices have taken the form of footrests supported on a bed and selectively movable between beds. These footrests have had in common the failure to accommodate hospital beds of differing configurations, constructions, and dimensions. The differences, such as the width of the frame and springs, the nature of the frame rails, the configuration of the safety rails, and the like, have accounted for the fact that many prior art footrests cannot be secured to various hospital beds with the rigidity required to provide stimulation to the legs and feet of the bedridden person. For example, some footrests are provided with clamping brackets which accommodate a variety of bed frame members, yet do not secure effectively to any of them.

SUMMARY OF THE INVENTION

The present invention provides a bed footboard assembly which easily accomodates beds of differing mattress height, rail width, and rail configuration. It includes a footboard secured between slotted plates which extend from vertical support bars disposed on opposite sides of a bed. Each vertical support bar is slidably secured in a collar which extends from a support bracket borne by each frame rail of the bed. Each support bracket includes a right angle member having a horizontal leg resting on the bed frame rail, and a vertical leg from which the collar extends. A clamping plate is opposed to the vertical leg of each bracket and secured thereto by a bolt and wing nut. Each frame rail is releasably clamped between each vertical leg and its associated clamping plate, and the footboard rests on the mattress of the bed.

THE DRAWING

DESCRIPTION OF THE PREFERRED EMBODIMENT

Figure 1:
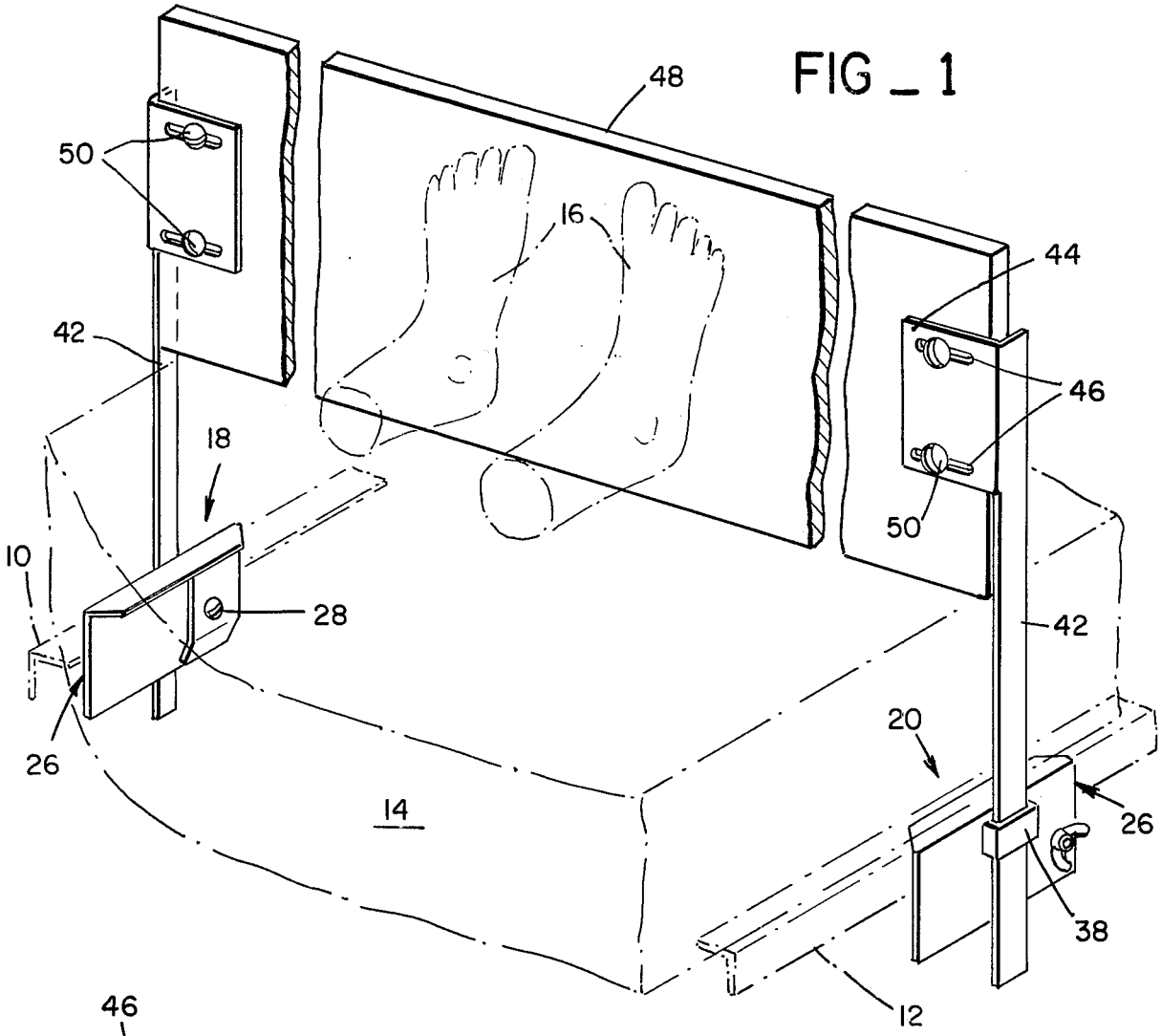
FIG. 1 is a perspective view of the present invention in use in conjunction with a bed.

The present invention comprises a footboard assembly particularly adapted to be easily secured to and removed from beds of various widths, heights, and constructions. As shown in FIG. 1, a typical bed such as is found in a hospital includes a pair of opposed, right angular frame rails 10 and 12 which support a mattress 14. For a patient confined to bed for an extended period of time, a footboard assembly should be provided to maintain the muscle tone of the patient's feet 16 and legs.

Figure 2:
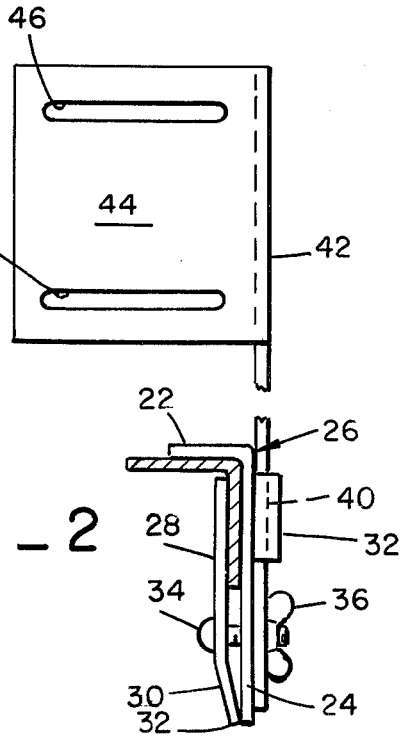
FIG. 2 is a front view of a portion of the present invention.
Figure 3:
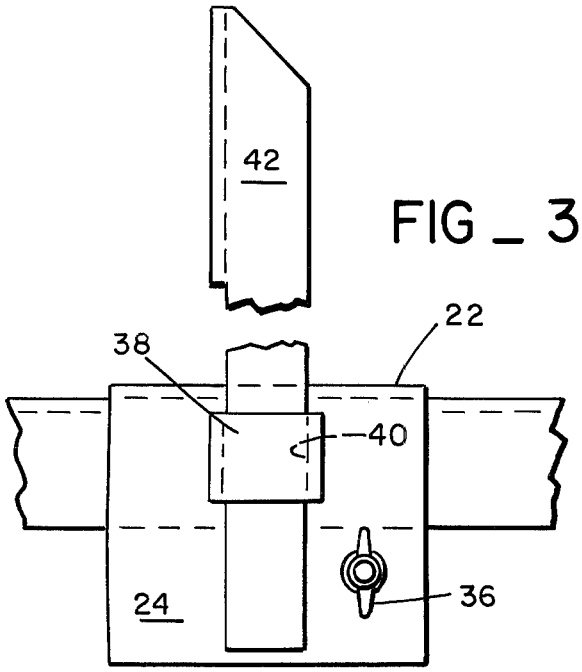
FIG. 3 is a side view of a portion of the present invention.

The footboard assembly of the present invention includes a pair of support brackets 18 and 20 which are removably secured to the frame rails 10 and 12, respectively. Each support bracket comprises a right-angular member 26 having a horizontal leg 22 and a vertical leg 24 depending therefrom. The horizontal leg 22 is disposed to rest on the frame rail of the bed, and the vertical leg is disposed parallel and adjacent to the vertical portion of the frame rail. Each bracket is provided with a clamping plate 28 which includes a lower portion 30 angularly offset toward the vertical leg 24. The angular offset is provided so that the edge 32 of the clamping plate will impinge upon the vertical leg 24 with the vertical portion of the frame rail disposed between the clamping plate and the vertical leg 24, as shown in FIG. 2.

The clamping plate and the vertical leg are provided with aligned holes through which a bolt 34 extends. A wing nut 36 or the like is threadedly received on the bolt, drawing the clamping plate and vertical leg together and clamping the frame rail therebetween. This construction allows the bracket to be easily secured to a frame rail, and provides superior support laterally as well as vertically.

Extending outwardly from each vertical leg 24 is a rectangular collar 38 having a vertical slot 40 therethrough. Slidably received in the slot 40 is an upwardly extending support bar 42. The upper end of the support bar is provided with a laterally extending plate 44 secured thereto. Each plate 44 is provided with two horizontal slots 46. A footboard 48 is supported between the plates 44 by means of bolts or the like received in the slots 46. The slots permit the footboard assembly to accomodate beds of various widths.

It may be appreciated that the installation of the present invention on a bed involves merely placing the brackets 20 on the frame rails and clamping them thereto with the bolt and nut combination 34 and 36. The footboard is loosely secured to the plates 44, and the support bars 42 are inserted in their respective collars 40. The footboard is allowed to slide down until it is supported by the mattress. The bolts 50 are then tightened to provide firm support for the feet of the patient. Removal of the apparatus is equally simple and quick. The invention is adaptable to beds having frame rails of various sizes and widths, as the clamping plate may be used with any frame rail having a vertical portion or web.

We claim:

1. A footboard assembly comprising: a footboard; a pair of opposed vertical supports secured to the ends of said footboard; a pair of support brackets each receiving one of said vertical supports and removably secured to a framerail of a bed, each support bracket including a horizontal member adapted to rest on a frame rail of a bed and a vertical member depending from said horizontal member; a clamping plate adjustably secured to said vertical member, said clamping plate including a lower portion angularly offset toward said vertical member and a lower edge impinging on said vertical member, said clamping plate including an upper portion spaced apart from said vertical member and opposed thereto for receiving the frame rail therebetween, said vertical member includes a collar extending outwardly therefrom, said collar includes a slot extending vertically therethrough for receiving one of said vertical supports in sliding fashion.

2. The footboard assembly of claim 1, wherein each vertical support includes a web extending laterally from the upper end thereof.

3. The footboard assembly of claim 2, wherein said web includes a plurality of lateral slots for securing said footboard in adjustable width fashion.

* * * * *